United States Patent [19]

Kusz

[11] Patent Number: 4,573,582

[45] Date of Patent: Mar. 4, 1986

[54] RING SEAL TAMPER INDICATING DEVICE

[75] Inventor: Maximillian Kusz, Waterville, Ohio

[73] Assignee: Owens-Illinois, Inc., Toledo, Ohio

[21] Appl. No.: 602,790

[22] Filed: Apr. 23, 1984

[51] Int. Cl.[4] ..... B65D 41/32

[52] U.S. Cl. ..... 206/807; 215/232

[58] Field of Search ..... 277/189, DIG. 6, DIG. 10; 206/807; 215/232

[56] References Cited

U.S. PATENT DOCUMENTS 3,952,869 4/1976 Sansom ..... 206/807
4,223,897 9/1980 Staab ..... 277/DIG. 6
4,418,834 12/1983 Helms et al. ..... 215/232
4,423,819 1/1984 Cummings ..... 206/807

*Primary Examiner*—Robert I. Smith
*Attorney, Agent, or Firm*—John R. Nelson

[57] ABSTRACT

A ring seal tamper indicating device is disclosed in the form of a preselectively fracturable ring seal for sealing the space between a container and its closure. The ring seal has an adhesive on its top and bottom surfaces whereby removal of the closure causes the ring seal to fracture or distort to warn the user of prior tampering. As an alternative, the ring seal may be impregnated with an adhesive.

14 Claims, 7 Drawing Figures

RING SEAL TAMPER INDICATING DEVICE

This invention relates to ring seals for sealing the space between a container and its closure, and more particularly to such a ring seal that is preselectively fracturable or distortable to warn the user of prior tampering.

Containers which are sealed with a closure cap, as for example, a package comprising a glass container and a metal closure cap are very common. Such packages are now used in quantities numbering many millions per day for packaging a variety of products, particularly food and pharmaceutical products. The enormous quantities of the packages being used requires them to be easily sealed by the packer and as well as being easily opened and reclosed by the consumer.

A variety of caps and container finishes have been produced for some time using lugs or threads for removably attaching the closure caps to the containers. Many of these caps are applied to the containers by machinery which twists the caps onto container threads and in other cases the caps are applied to special glass finishes which permit the caps to be pressed on and twisted off.

Lately a dire need has appeared to provide such containers and their closures with some type of indicating means to warn the ultimate user of any prior tampering therewith. Also, there is a continuing need for a reduction of cost and an increase in reliability of such tamper indicating means.

Therefore, it is an object of the invention to provide containers and their closures of the above type with a tamper indicating means to warn the user of any possible prior tampering therewith.

A further object is to provide a tamper indicating device for the above type containers and closures in the form of a ring seal that is selectively fracturable or distortable to warn the user of prior opening.

A further object is to provide a tamper indicating device of the above type that is simple in construction, inexpensive and easy to manufacture, and highly effective in operation.

Briefly, the foregoing objects are accomplished by the provision of a ring seal tamper indicating device in the form of a compressible, preselectively fracturable ring seal for sealing the space between a container and its closure. The ring seal has an adhesive on its top and bottom surfaces whereby removal of the closure causes the ring seal to fracture or distort to warn the user of prior tampering. The adhesive is of such strength that it is stronger than the tear strength of the ring seal. This requires the ring seal to be broken or removed before the closure can be removed from the container. As an alternative, the ring seal may be impregnated with an adhesive such as a thermoplastic foam having encapsulated liquid adhesive. The compression of the ring seal between the closure and container would rupture the foam causing an adhesive to be applied to the closure and container at the ring seal contact area.

A variety of materials may be used for the ring seal such as, for example, thermoplastic materials, paper, thin metal, cork, foam plastic, or combinations thereof. In the preferred form, the ring seal is formed of compressible material.

In one form of the invention, the ring seal has a thin film of metal formed on at least one of its surfaces enabling the seal to be induction heat sealed onto the closure and/or container.

In a modification, the ring seal is partially projecting, semi-resilient tabs extending out from at least one of its top or bottom surfaces to compensate for dimensional variances in the container and/or closure. Also, the ring seal may form an integral part of the closure or the container.

In a further modification, the ring seal is formed of a layer of thermoplastic foam interposed between two layers of thermoplastic film. Also, the ring seal may be L-shaped or T-shaped in cross-section to facilitate removal thereof from the container.

Other objects and advantages of the invention will be apparent from the following description taken in conjunction with the drawings wherein.

In the drawings, like numbers and letters are used to identify like and similar parts throughout the several views.

Figure 1:
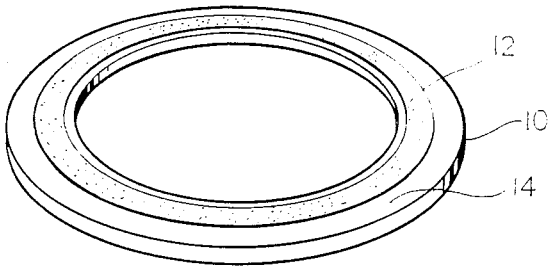
FIG. 1 is a perspective view of a ring seal construction in accordance with the invention.
Figure 2:
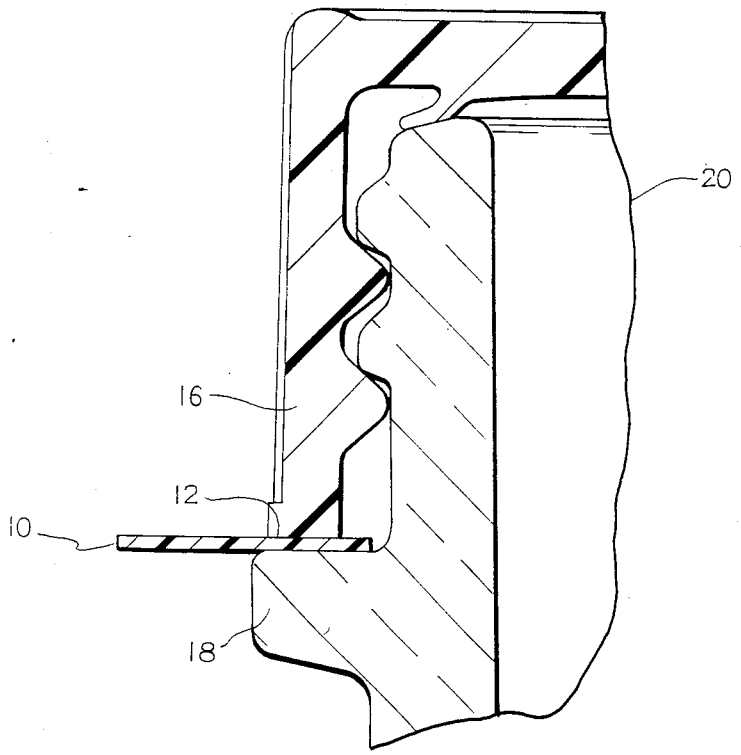
FIG. 2 is an enlarged portional front elevational view showing the ring seal of FIG. 1 applied in operational position between a container and its closure.
Figure 3:
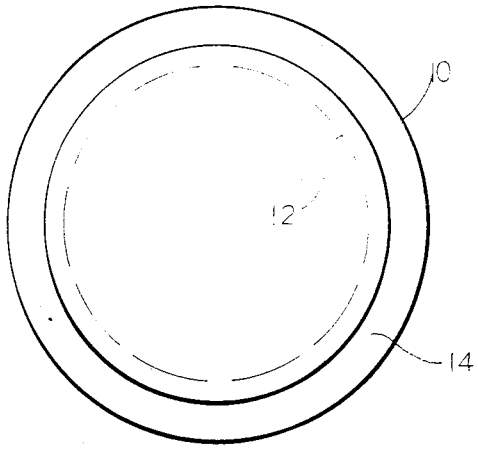
FIG. 3 is a top plan view of the seal ring shown in FIG. 1.

Referring first to FIGS. 1 and 3, there is shown a washer shaped disk or ring seal 10, formed of preselected fracturable and/or distortable material in accordance with the invention, such seal having an adhesive 12 applied to its top surface 14. When the seal 10 is disposed in operative position between a container lid or closure 16 (FIG. 2) and the neck 18 of the container 20, the lid 16 is in relatively tight contact with the adhesive 12 and any movement of the lid will cause the seal 10 to fracture or distort thereby providing a means for warning a subsequent user of prior use or tampering.

Figure 4:
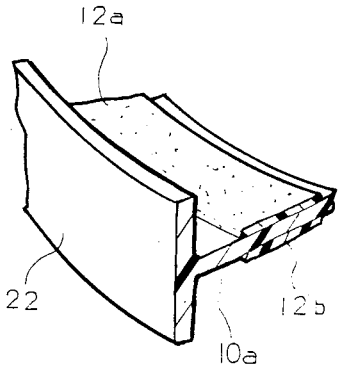
FIG. 4 is an enlarged portional perspective view of a modification of the seal ring shown in FIG. 1.
Figure 5:
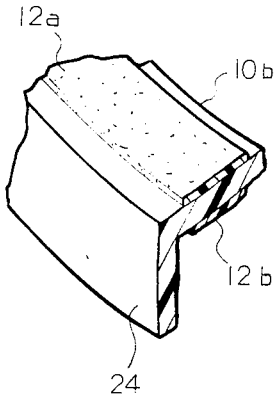
FIG. 5 is a portional perspective view of a modification of the seal ring shown in FIG. 4.

In FIG. 4, the ring seal **10*a* is T-shaped in cross-section whereby the cross-bar 22 of the T-shape provides a handle enabling the user to easily remove the ring seal from the container or lid. Likewise, in FIG. 5, there is shown a ring seal 10*b* that is L-shaped in cross-section enabling the user to grasp the outer leg 24 of the L-shape as a removal handle. In the FIGS. 3 and 4 embodiments, each seal has a top adhesive 12*a* applied to its top surface and a bottom adhesive 12*b* applied to its bottom surface to better ensure fracturing or distorting of the seal on removal of the lid 16**.

Figure 6:
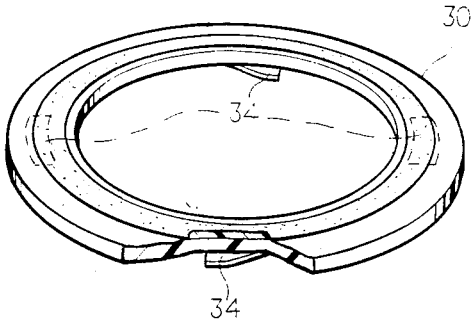
FIG. 6 is a perspective view, partly in section, of the seal ring of FIG. 1, but showing a modification thereof.

Referring to FIG. 6, the ring seal 30 has a plurality of downwardly extending resilient tabs 34 to provide additional resiliency and sealability of the seal 30, and to compensate for dimensional variances in the container and closure.

Figure 7:
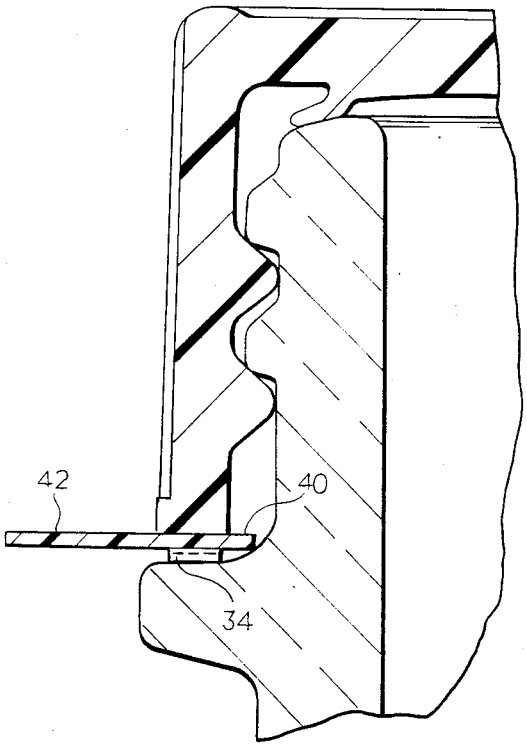
FIG. 7 is an enlarged portional side elevational view showing the ring seal of FIG. 6 applied in operational position between a container and its closure.

In FIG. 7, the ring seal 40 is similar to the seal 30 of FIG. 6, but has an added outer peripheral extended flange 42 which functions as a handle to enable the user to easily remove the seal from the lid or container. Also in FIG. 7, the tab(s) 34 (of FIG. 6) is shown in compressed or applied position.

The ring seals may be formed of any suitable compressible material that is preselectively fracturable and/or distortable. Also, the materials selected depend on the specific application to various types of containers and closures. Typical materials are paper, metal, thermoplastic, foam plastic, cork and combinations thereof.

In the case of plastic closures or containers, the top and/or bottom of the seal ring could be metallic such that an induction unit could be utilized to cause the seal to adhere to the closure and/or container. See FIGS. 4 and 5 where the "adhesive" is replaced by a thin metal (aluminum) layer.

Several compositions of the seal are possible with the end effect being a ring seal that prevents a closure from being removed from a container without the seal first being removed.

As aforementioned, the ring seal is composed of a compressible material, such as a thermoplastic foam, with an adhesive medium applied to one or both surfaces. The seal is placed on the container and rests ultimately on the container neck ring or shoulder. A closure is applied in the normal manner appropriate for the closure. When fully applied, the closure is sealed to the container by means of the adhesive on the seal adhering to the bottom of the closure and adhesive on the opposite side of the seal adhering to the neck ring or other appending surface of the container, such as the shoulder of the container. The adhesive medium is of such strength that it is stronger than the tear strength of the "compressible material". This requires the seal to be broken or removed before the closure can be removed from the container. For packages having a screw type closure the seal will break and cause noticeable tearing of the ring seal if the closure is rotated so as to remove the closure from the container.

The ring seal is made of a compressible material so that it permits the inside top surface of the closure (or closure liner) to contact the top of the container where such contact is necessary or desirable to effectively close the package. The compressible material in the ring seal also eliminates the need to maintain close tolerance "fits" between the closure and container finish in the ring seal area.

While use of a compressible material is desirable, it is not necessary if mechanical means are incorporated in the ring seal to eliminate variances in dimensions in the closure and container finish. One such mechanical means is the tabs 34 aforedescribed.

The lever tabs 34 may be formed by metal stamping, thermoforming, injection molding, or other means commonly utilized for the ring seal material chosen. The means of closing and sealing the package is such that the ring seal is placed on the container finish, then the closure is applied and tightened. The lever tabs 34 contact the seal ring and are deflected as the closure is applied, contacting the opposite side of the seal ring.

This invention requires the ring seal to adhere to the closure and container when the closure is applied to the container. While it is obvious to use a pressure sensitive adhesive on both sides of the ring seal, the invention is not limited to such. An adhesive could be applied to the seal contacting surfaces of the closure or container or ring seal in any combination as long as the end result is achieved. Likewise, the use of an adhesive could be eliminated if other means of causing adherence of the ring seal to the closure and/or container are incorporated or implemented. Examples of such means are:

(1) Using metallic ring seals which could be caused to adhere to the closure and/or container by induction or conduction, microwave heating. An adhesive surface can be replaced by a thin metal film as previously described in connection with FIGS. 5 and 6.

(2) Use of adhesive impregnated into the seal material, as previously described, such that contact and/or compression of the ring seal material causes release or activation of an adhesive medium.

The composition of the ring seal itself may be of one or more materials including, but not limited to paper, metal, plastics, plastic foams, etc. or combinations of these materials. For example: A thin wire or string could be attached to or imbedded in a thermoplastic foam to facilitate removal of the ring seal, much like a band is provided to remove the outer wrapping of a pack of cigarettes. Another example would be a layer of thermoplastic foam sandwiched between two layers of thermoplastic film, metal foil, Mylar TM (polyethylene terephthalate) film, etc., so that the seal ring could be pulled away from the package breaking the bond between the seal ring and the closure, and/or the seal ring and the container. Any rotating of the closure relative to the container will cause visible tearing of the foam and/or wrinkling of the other two layers of material.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. A ring seal for sealing the space between a container having a neck portion and a top opening and a closure therefor, the ring seal having a portion located externally of the neck of the container and the closure, the ring seal being away from the top opening, said ring seal having an adhesive on at least one of its top and bottom surfaces whereby removal of the closure causes the ring seal to fracture or distort externally of the container to warn the user of prior tampering.

2. The structure of claim 1 wherein the ring seal is formed of compressible material.

3. The structure of claim 2 wherein the ring seal is formed of foam plastic.

4. The structure of claim 1 wherein the ring seal has a thin film of metal formed on at least one of its surfaces enabling the seal to be induction heat sealed onto the closure or container.

5. The structure of claim 1 wherein the ring seal has partially projecting, semi-resilient tabs extending out from at least one of its top or bottom surfaces to compensate for dimensional variances in the container and/or closure.

6. A container having a neck portion, an opening at the top thereof and a closure for the neck portion adapted to close the container, a distortable ring seal located between the container and its closure, the ring seal located on the neck portion away from the top opening and a portion of the ring seal being external of the container and the closure, said ring seal having a sealant impregnated in foam plastic, the removal of the closure causing the ring seal to fracture or distort externally of the container and closure to warn the user of prior tampering.

7. The structure of claims 1 or 6 wherein the ring seal forms an integral part of the closure or the container.

8. The structure of claim 1 wherein the ring seal is formed of paper.

9. The structure of claim 1 wherein the ring seal is formed of metal.

10. The structure of claim 1 wherein the ring seal is formed of a thermoplastic material.

11. The structure of claim 1 wherein the ring seal is formed of a combination of metal and thermoplastic materials.

12. A ring seal in combination with a container having a neck portion and a top opening and a closure for a container, the ring seal having a top face and a bottom face and at least one face being adhesively sealed between the closure and the neck portion of the container when the closure is fastened on the container, the ring seal located on the neck portion away from the top opening and a portion of the ring seal being external of the container and the closure, the ring seal being so constructed and arranged that the seal distorts sufficiently to indicate tampering when the closure is removed from the container or an attempt is made to remove the closure.

13. A ring seal as defined in claim 12 in which the ring seal is adhesively secured to the closure and the container by adhesive on both faces.

14. A ring seal as defined in claim 12 in which the ring seal is formed from foam plastic.

* * * * *